US005746637A

United States Patent [19]

Hunt

[11] Patent Number: 5,746,637

[45] Date of Patent: May 5, 1998

[54] CHILDREN'S BOOK CONSTRUCTION

[75] Inventor: Waldo Henley Hunt, Encino, Calif.

[73] Assignee: The Hunt Group, Santa Monica, Calif.

[21] Appl. No.: 712,159

[22] Filed: Sep. 11, 1996

Related U.S. Application Data

[63] Continuation of Ser. No. 570,781, Dec. 12, 1995, abandoned.

[51] Int. Cl.[6] ..... A63H 3/00; A63H 33/38; A63H 3/02

[52] U.S. Cl. ..... 446/72; 281/29; 281/37; 446/148

[58] Field of Search ..... 446/72, 73, 75, 446/147, 148, 327, 328, 329, 369; 281/29, 37, 51; 434/178

[56] References Cited

U.S. PATENT DOCUMENTS

| | | | |
|---|---|---|---|
| D. 143,943 | 2/1946 | Von Baumann . | |
| 1,365,335 | 1/1921 | Miles | 281/37 |
| 1,490,295 | 4/1924 | Stephens | 446/147 X |
| 3,161,423 | 12/1964 | Hertzberg | 281/29 |
| 3,174,773 | 3/1965 | True et al. | 281/29 |
| 3,736,603 | 6/1973 | Rothman . | |
| 4,152,865 | 5/1979 | Ikeda | 446/72 |
| 4,176,473 | 12/1979 | Rae | 446/174 X |
| 4,233,772 | 11/1980 | Hamar | 446/29 X |
| 4,439,941 | 4/1984 | Halperin | 446/147 X |
| 4,508,515 | 4/1985 | Skolnick | 446/148 |
| 4,597,743 | 7/1986 | Becker et al. | 446/71 |
| 4,608,024 | 8/1986 | Skolnick | 446/148 |
| 4,832,648 | 5/1989 | Theobald et al. . | |
| 4,865,574 | 9/1989 | Kobayashi | 446/72 |
| 4,874,340 | 10/1989 | Smallwood . | |
| 4,898,404 | 2/1990 | Babcock | 281/51 X |
| 4,936,460 | 6/1990 | Meyer | 446/75 X |
| 5,038,755 | 8/1991 | Burgio et al. . | |
| 5,059,149 | 10/1991 | Stone . | |
| 5,208,934 | 5/1993 | Bachnick et al. | 446/369 X |

FOREIGN PATENT DOCUMENTS

| | | | |
|---|---|---|---|
| 0206500 | 12/1986 | European Pat. Off. | 446/73 |
| 567972 | 10/1957 | Italy | 446/147 |
| 2110098 | 6/1983 | United Kingdom | 446/369 |
| 83/01392 | 4/1983 | WIPO | 446/327 |

OTHER PUBLICATIONS

*"Pinocchio,"* J.S.N.Y. (Prior Art—Date Unknown).
*"The Fox's Tale,"* Graham Percy, 1994.
*"Sailor Pig,"* Joshua Morris Publishing, Inc., 1993.

*Primary Examiner*—Mickey Yu
*Assistant Examiner*—D. Neal Muir
*Attorney, Agent, or Firm*—Oppenheimer Poms Smith

[57] ABSTRACT

A book particularly suitable and attractive to young children. Relatively stiff front and rear covers open and shut along a side spine to expose and cover a plurality of pages in a typical book fashion. The rear cover is formed of two cardboard or other relatively stiff layers or sheets. A plush toy configured to resemble an upper portion of a figure has a thin base sandwiched between the cardboard layers and adhered therein. Thereby the toy extends above the top edge of the rear cover. On the back of the rear cover is a design aligned and continuous with the toy and depicting a lower portion of the figure. The story written on the pages is about the figure and the figure is preferably illustrated on the front cover. For example, the figure can be a bear, the story can be "Goldilocks and the Three Bears," the figure upper portion can include the bear's head, chest and outstretched front legs (arms), and the rear cover design can be the bottom half of the bear. The toy has width and thickness dimensions similar to those of the rest of the book to conveniently fit in rectangular packaging.

36 Claims, 2 Drawing Sheets

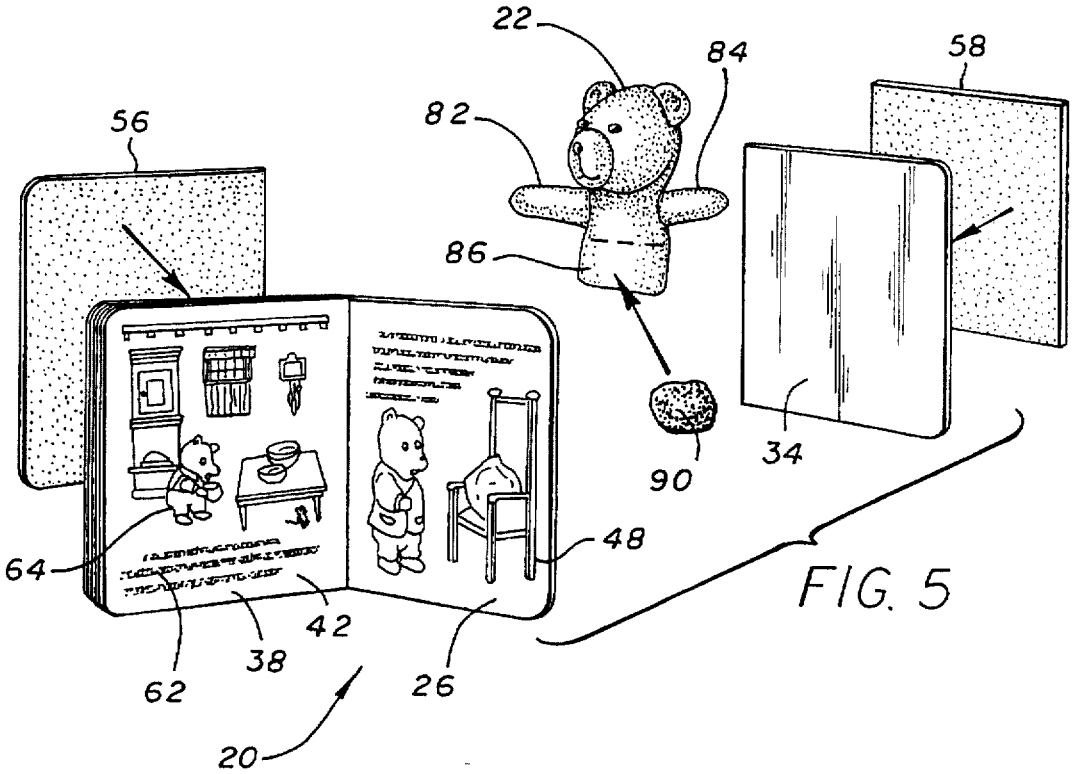
FIG. 5
FIG. 6
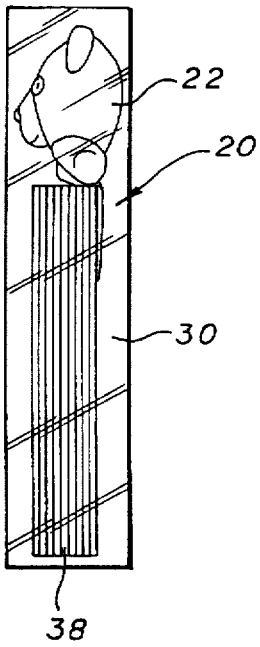
FIG. 7
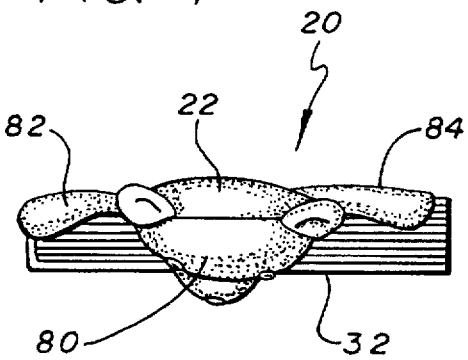

CHILDREN'S BOOK CONSTRUCTION

CROSS-REFERENCE TO RELATED APPLICATION

This is a continuation of application Ser. No. 08/570,781, filed Dec. 12, 1995, now abandoned.

BACKGROUND OF THE INVENTION

The present invention relates to the design and construction of books, particularly children's books.

It is important that children learn to enjoy reading and books. Children's books are designed for such purpose typically with large colorful and interesting pictures. One example thereof is the stuffed animal with book enclosure as disclosed in U.S. Pat. No. 5,059,149. It shows a stuffed animal toy having a front flap on the chest area of the animal. When the flap is opened, a book is exposed. A cassette holding compartment may be provided on the stuffed animal.

An example of another prior art children's book is that which is copyrighted by J.S.N.Y. It comprises a cloth stuffed doll having a head, arms, legs and stack of bibs or front shirts attached along the top edges thereof below the doll head. Each bib has a portion of the book story on one (front) side and a face on the other (rear) side. As the front side is read, the bib is flipped up so that the rear side covers the face of the doll. The story portion on the front side of the next bib concerns the figure depicted by the rear side face. When that story portion has been read the second bib is flipped up and so on. The final portion of the story is then printed on the doll's chest.

Further examples of popular children's books which children find intriguing are those which involve the children's senses of touch and smell, such as "Pat the Bunny" by Dorothy Kunhardt and "Fuzzy as a Puppy" by Audean Johnson. Examples of other books or book covers of the prior art are shown in U.S. Pat. Nos. 4,874,340, Des. 143,943 and 4,832,648.

Further book constructions which interest children in books in unique and different ways are thus desirable.

SUMMARY OF THE INVENTION

Disclosed herein is a unique, attractive and appealing children's book construction. The front and rear covers and pages of this book can be of a conventional type construction, each formed of stiff durable material, such as cardboard, with a slick paper coating. The children's story is printed on the paper coating. A plush toy is attached to the rear cover, extending above the top edge thereof. The toy has its lower edge sandwiched between the two cardboard sheets of the rear cover in a fixed embedded arrangement.

The toy is configured to resemble the upper portion of a figure. On the back side of the rear cover is a drawing or picture aligned with the toy and depicting the lower portion of the figure, and generally continues with the figure upper portion. The toy can include the head and arms of the figure, which can be a bear, for example, and the drawing can be of the lower torso and hind legs of the bear. The figure would be selected as relating to or being one of the characters in the story. Thereby the book becomes readily recognizable to the child, particularly pre-school children. This not only makes it more identifiable to the child when displayed on the store shelves and also more appealing, since plush toys (stuffed animals) by themselves are very popular with young children.

The plush toy is configured so as to have maximum width dimensions less than that of the covers so as to not stick out beyond the sides. The thickness of the toy is substantially the same as the rest of the book. Thus, the toy fits compactly in a rectangular box with the rest of the book.

Pursuant to another definition of the invention provided herein is a children's educational book and toy assembly. The assembly includes a children's generally rectangular book and having a front, a back, upper and lower ends, and a predetermined thickness and width. The book has pictures of at least one specific figure such as an animal or a person. A three dimensional figure generally corresponding to the specific figure is secured to the back of the book. The figure extends above the top of the book, and has a thickness substantially equal to the thickness of the book, and a lateral extent approximately equal to the width of the book. The back of the book bears an image corresponding to an extension of the figure, so that, when viewed from the rear, the image and the figure form a continuous representation of the specific figure. The dimensions of the assembly are such that the assembly has a width and thickness substantially equal to the width and thickness of the book, and a length equal to the length of the book plus the outward extend of the specific figure, for ease in packaging.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 5 is an exploded perspective view of the book showing the construction of the rear cover and securement of the plush toy thereto;

FIG. 6 is a side elevational view of the book and packaging of FIG. 1; and FIG. 7 is a top plan view of the book.

DETAILED DESCRIPTION OF PREFERRED EMBODIMENTS OF THE INVENTION

Figure 1:
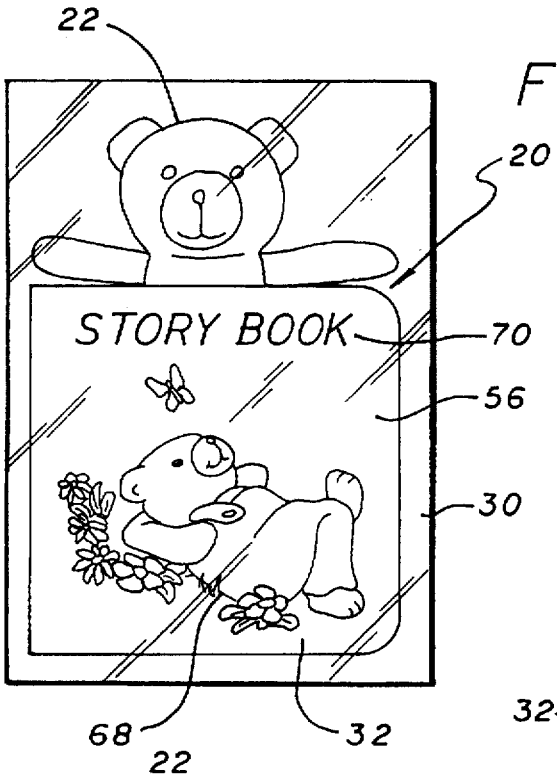
FIG. 1 is a front view of a children's book of the present invention shown enclosed in box-type packaging.

A children's book construction of the present invention is shown in the drawings generally at 20. As will be described in greater detail later, a plush toy 22 is secured to and extends above the top edge 24 of the back cover 26 of the book construction 20. Book construction 20 is illustrated in isolation in FIGS. 2–5 and 7 and in a generally rectangular packaging 30 as shown in FIGS. 1 and 6. Packaging 30 is preferably clear, transparent, so that the intended purchaser can readily see the book construction 20.

Figure 4:
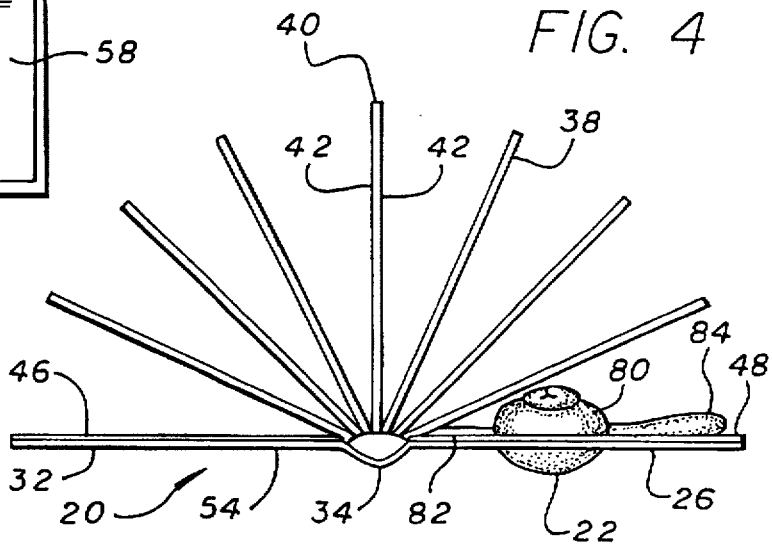
FIG. 4 is a bottom plan view of the book shown in an open position.

Relatively stiff front and back covers 32, 26 are connected by a spine 34 as shown in FIG. 4. The front cover 32 can be opened to expose and access the relatively stiff or rigid pages 38, seven pages are illustrated in FIG. 4. Each page 38 can be formed of a cardboard sheet 40 with slick paper sheets 42 adhered thereto on both sides.

The front and back covers 32, 26 each include a sheet of cardboard 46, 48, respectively. Slick paper coats the inside surfaces of the cardboard sheets 46, 48. A long sheet of stiff paper 54 or the like covers the outside surfaces of both front and back covers 32, 26 extending from one to the other and forming the spine 34, as illustrated in FIG. 4. Paper sheets 56, 58 are adhered to the outside surfaces.

Figure 2:
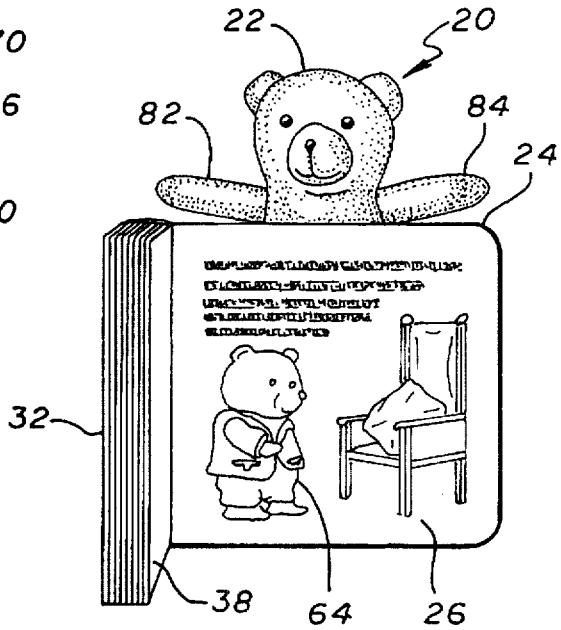
FIG. 2 is a front perspective view of the book of FIG. 1 shown removed from the packaging and in a partially open position.
Figure 3:
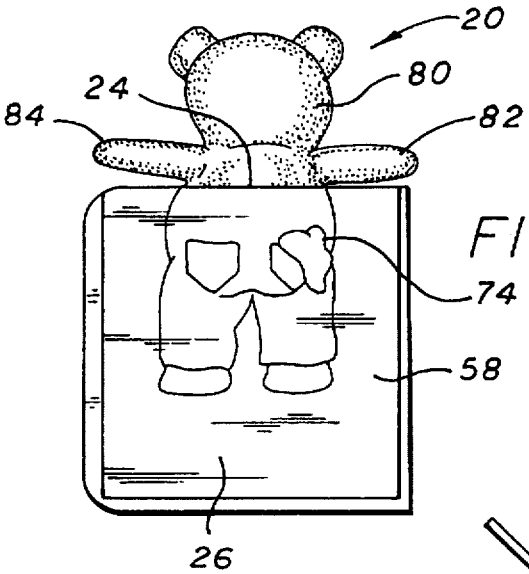
FIG. 3 is a rear elevational view of the book of FIG. 1 shown removed from the packaging.

The story of the book construction 20 is printed or otherwise provided on the slick paper sheets 42 on the pages 38. The story includes appropriate words 62 and pictures 64, as shown in FIGS. 2 and 5. A picture 68 representative of the story and the story title 70 are printed on the front cover 32.

The story preferably concerns a figure, such as a person or animal real or imaginary. The plush toy 22 is configured to resemble the upper portion of that figure. This makes the story itself more easily identifiable and recognizable by seeing the book construction 20 at a distance, and especially for young children who cannot yet read the title 70 but can recognize the figure of the plush toy 22. This also makes the book construction 20 more attractive and appealing when on the store shelves, especially to preschool children. Additionally, it helps the child recognize and identify the book and its story when he gets home.

The back side of the rear cover 26 includes a depiction 74 of a lower portion of the figure, aligned and generally continuous with the plush toy 22. This uniquely provides a representation of an entire backside of the figure when the book construction 20 is viewed from the back. The depiction 74 can be a drawing, a raised image such as pieces of different colored felt glued to the surface or other constructions as would be apparent to those skilled in the art.

The plush toy 22 or other sculpted or three dimensional figure is preferably a soft pliable construction. It can be a stuffed animal type construction and can have a soft "furry" cover over a pliable stuffed interior. According to a preferred embodiment the toy 22 represents the upper portion of the figure including the head 80 and outstretched arms 82, 84. The lower edge 86 of the toy 22 is flat and fixedly embedded in the rear cover 26, as shown in FIG. 5. Preferably it is sandwiched between the sheet and cardboard and secured therein with adhesive 90.

The plush toy 22 is illustrated as preferably secured to and extending above the top edge of the back cover 26. However, it is also within the scope of the invention to alternatively mount it to one of the pages (38) or the front cover (32). In such case, the figure lower portion depiction (74) can be on the back of the back cover 26 or the back of that page or front cover.

The outstretched arms 82, 84 do not stick out beyond the side edges of the covers 32, 26. That is, the total width of the toy 22 and covers 32, 26 are essentially the same. Similarly, the toy 22 has a thickness substantially the same as the closed book, as can be understood from FIG. 6. This allows the book construction 20 to be easily contained in the packaging 30.

As an example and referring to the drawings, the story can be a variation on the classic "Goldilocks and the Three Bears" story, the figure can be a bear, a bear of the story can be shown on the front cover 32 as part of the picture 68 and on the pages 38, and the depiction 74 on the back of the back cover 26 can be the lower half of the bear depicted wearing pants.

From the foregoing detailed description, it will be evident that there are a number of changes, adaptations and modifications of the present invention which come within the province of those skilled in the art. Thus, by way of example and not of limitation, the three dimensional figure or plush toy may have an extent greater than the thickness and width of the book; and the book and toy assembly may not be in a rectangular package but may be packaged and shipped in bulk or in any other manner for shipment or display. However, it is intended that all such variations not departing from the spirit of the invention be considered as within the scope thereof as limited solely by the claims appended hereto.

What is claimed is:

1. A children's educational book and toy assembly, comprising:

a children's book in general rectangular configuration and having a front, back, upper and lower ends, and a predetermined thickness, and width;

said book including pictures of at least one specific figure such as an animal or a person;

a three-dimensional plush toy figure generally corresponding to said specific figure secured to a back of said book, said three-dimensional plush toy figure extending above a top of said book, and having a thickness substantially equal to the thickness of said book, and a lateral extent approximately equal to the width of said book; and said back of said book bearing an image corresponding to an extension of said specific figure, so that, when viewed from a rear, the image and said three-dimensional plush toy figure form a continuous representation of said specific figure;

wherein the dimensions of said assembly are such that said assembly has a width and thickness substantially equal to the width and thickness of said book, and a length equal to the length of said book plus an outward extent of said specific three-dimensional plush toy figure, for ease in packaging of said assembly; and wherein said plush toy figure is constructed and attached to said book so as to be rigid enough to be upright self-standing relative to said book.

2. A children's book construction, comprising:

a front cover;

a relatively stiff rear cover having a top edge;

a page between said front and rear covers;

wherein said front cover, said rear cover and said page are secured relative to one another to open and close from one side to another in book fashion to provide access to said page;

a plush toy configured to resemble an upper portion of a figure, said plush toy being secured to said rear cover, extending up from said top edge, and facing forward;

wherein said plush toy is constructed and secured to said rear cover so as to be rigid enough to be upright self-standing relative to said rear cover;

lower portion indicia on a back side of said rear cover generally adjacent said top edge and aligned and continuous with a rear side of said plush toy and depicting a back side of a lower portion of said figure; and story indicia telling a story concerning said figure, at least a portion of said story indicia being on said page.

3. The book construction of claim 2 wherein said plush toy has a maximum width dimension thereof no greater than that of said rear cover.

4. The book construction of claim 3 wherein said plush toy has a maximum thickness dimension thereof less than a maximum thickness defined by and between said front cover and rear cover with said front cover in a closed position.

5. The book construction of claim 4 further comprising packaging enclosing said front and rear covers, said page and said plush toy.

6. The book construction of claim 2 wherein the upper portion includes arms and a head of the figure.

7. The book construction of claim 6 wherein said arms are outstretched in opposite width directions relative to said rear cover.

8. The book construction of claim 7 wherein the figure is a bear.

9. The book construction of claim 2 wherein said plush toy has a maximum thickness dimension substantially the same as a maximum thickness defined by and between said front and rear covers with said front cover in a closed position.

10. The book construction of claim 2 wherein said rear cover comprises cardboard with a slick paper cover adhered thereto.

11. The book construction of claim 2 wherein said rear and front covers both have the same width, length and thickness dimensions.

12. The book construction of claim 2 wherein said rear cover has first and second layers, and a lower portion of said plush toy is sandwiched in securement between said layers.

13. The book construction of claim 2 wherein said lower portion indicia comprises a drawing of legs and lower trunk of the figure.

14. The book construction of claim 2 further comprising indicia on a front side of said front cover depicting the figure.

15. A children's book construction, comprising;

a front cover;

a rear cover having a top edge;

a page between said front and rear covers;

wherein said front cover, said rear cover and said page are secured relative to one another to open and close from one side to another in book fashion to access said page;

wherein said rear cover includes first and second relatively stiff layers secured together; and a plush toy configured to resemble an upper portion of a figure and extending up from and above said rear cover top edge, said plush toy having a lower edge thereof sandwiched in securement between said first and second layers;

wherein said plush toy is constructed and secured to said rear cover so as to be rigid enough to be upright self-standing relative to said rear cover.

16. The book construction of claim 15 wherein said plush toy has a maximum width dimension less than that of said rear cover so as to not stick out at either side of said cover.

17. The book construction of claim 16 further comprising box shaped packaging enclosing said plush toy and said front and rear covers when closed.

18. The book construction of claim 17 wherein said packaging compresses said plush toy to have a thickness generally the same as that by and between said front and rear covers.

19. The book construction of claim 15 wherein said upper portion includes a head and arms of the figure.

20. The book construction of claim 15 wherein said plush toy includes a fuzzy outer material enclosing sponge-like inner material.

21. A children's book construction, comprising:

a front cover;

a rear cover;

a page between said front and rear covers;

wherein said front cover, said rear cover and said page are secured relative to one another to open and close from one side to another in book fashion to provide access to said page;

a three-dimensional plush toy configured to resemble an upper portion of a specific figure, said three-dimensional plush toy being secured to one of said front cover, rear cover and page and extending up from a top edge thereof;

wherein said plush toy is constructed and secured so as to be rigid enough to be upright self-standing relative to said top edge;

lower portion indicia on a side of said one of said front cover, rear cover and said page, or said rear cover generally adjacent said top edge and aligned and continuous with said three-dimensional plush toy and depicting a lower portion of said specific figure; and story indicia telling a story concerning said specific figure, at least a portion of said story indicia being on said page.

22. The assembly of claim 1 wherein said plush toy figure includes a head, arms and upper chest of said specific figure, and said arms and upper chest are fully stuffed and non-hollow.

23. The assembly of claim 2 wherein said plush toy includes a head, arms and upper chest of the upper portion of the figure, and said arms and upper chest are fully stuffed and non-hollow.

24. The book construction of claim 15 wherein said plush toy includes a head, arms and upper chest of the figure, said arms and upper chest are stuffed and non-hollow.

25. The book construction of claim 21 wherein said plush toy includes a head, arms and upper chest of the figure, said arms and upper chest are stuffed and not hollow or open.

26. A children's book construction, comprising:

a front cover;

a relatively stiff rear cover having a top edge;

a page between said front and rear covers;

wherein said front cover, said rear cover and said page are secured relative to one another to open and close from one side to another in book fashion to provide access to said page;

a plush toy configured to resemble an upper portion of a figure, said plush toy is constructed and secured to said rear cover so as to be rigid enough to be upright self-standing relative to said rear cover and extend up from said top edge; and story indicia telling a story concerning the figure, at least a portion of said story indicia being on at least one of said front cover, said rear cover and said page.

27. The book construction of claim 26 further comprising lower portion indicia on said rear cover generally adjacent said top edge and generally aligned and continuous with said plush toy and depicting a lower portion of the figure.

28. The book construction of claim 27 wherein said indicia is on a back side of said rear cover.

29. The book construction of claim 28 wherein said plush toy is facing forward, and the lower portion of the figure is a back side thereof.

30. The book construction of claim 26 wherein the upper portion includes arms and a head of the figure.

31. The book construction of claim 26 wherein said rear cover includes first and second relatively stiff layers secured together, and said plush toy has a lower edge thereof sandwiched in securement between said first and second layers.

32. The book construction of claim 26 further comprising indicia on a front side of said front cover depicting the figure.

33. The book construction of claim 26 wherein the figure is an animal.

34. The book construction of claim 26 wherein said plush toy is generally centered on said top edge.

35. The book construction of claim 26 wherein said plush toy extends above top edges of said front cover and said page.

36. The book construction of claim 26 further comprising a spine connecting said front and rear covers together.

* * * * *